US010553939B2

(12) United States Patent
Daojian et al.

(10) Patent No.: US 10,553,939 B2
(45) Date of Patent: Feb. 4, 2020

(54) RADIATING ELEMENT OF ANTENNA AND ANTENNA

(71) Applicant: Huawei Technologies Co., Ltd., Shenzhen (CN)

(72) Inventors: Dingjiu Daojian, Munich (DE); Weihong Xiao, Shenzhen (CN); Yanmin Yu, Shenzhen (CN); Wei Luo, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 15/928,441

(22) Filed: Mar. 22, 2018

(65) Prior Publication Data

US 2018/0212323 A1 Jul. 26, 2018

Related U.S. Application Data

(63) Continuation of application No. PCT/CN2015/090404, filed on Sep. 23, 2015.

(51) Int. Cl.

| | |
|---|---|
| ***H01Q 19/10*** | (2006.01) |
| ***H01Q 1/52*** | (2006.01) |
| ***H01Q 1/48*** | (2006.01) |
| ***H01Q 1/38*** | (2006.01) |
| ***H01Q 21/00*** | (2006.01) |

(52) U.S. Cl.

CPC ..... *H01Q 1/523* (2013.01); *H01Q 1/38* (2013.01); *H01Q 1/48* (2013.01); *H01Q 19/10* (2013.01); *H01Q 21/0025* (2013.01)

(58) Field of Classification Search

CPC ..... H01Q 1/523; H01Q 1/246; H01Q 1/38; H01Q 1/48; H01Q 19/10

USPC ..... 343/834

See application file for complete search history.

(56) References Cited

U.S. PATENT DOCUMENTS

| | | | | |
|---|---|---|---|---|
| 5,982,336 | A * | 11/1999 | Wen | H01Q 9/16 333/134 |
| 10,193,236 | B1 * | 1/2019 | Lee | H01Q 15/14 |
| 2008/0036674 | A1 | 2/2008 | Riedel et al. | |
| 2009/0167611 | A1 | 7/2009 | Hsu et al. | |

(Continued)

FOREIGN PATENT DOCUMENTS

| | | | |
|---|---|---|---|
| CN | 101490902 | A | 7/2009 |
| CN | 101546863 | A | 9/2009 |

(Continued)

*Primary Examiner* — Huedung X Mancuso

(74) *Attorney, Agent, or Firm* — Slater Matsil, LLP

(57) ABSTRACT

Embodiments of the present invention relate to the communications field, and provide a radiating element of an antenna and an antenna. The radiating element includes: a reflection module, a power feed PCB disposed on the reflection module and electrically connected to the reflection module, and a radiating module disposed on the power feed PCB and electrically connected to the power feed PCB. A first surface of the power feed PCB includes a first signal cable and a grounding area of the radiating module. A second surface of the power feed PCB includes a grounding area of the power feed PCB and a second signal cable. The first signal cable is electrically connected to the second signal cable. The grounding area of the radiating module is electrically connected to the grounding area of the power feed PCB.

13 Claims, 4 Drawing Sheets

(56) References Cited

U.S. PATENT DOCUMENTS

| | | | | |
|---|---|---|---|---|
| 2011/0291907 | A1 | 12/2011 | Puzella et al. | |
| 2014/0145890 | A1* | 5/2014 | Ramberg | H01Q 9/28 343/726 |
| 2014/0218253 | A1 | 8/2014 | Puzella et al. | |
| 2015/0097748 | A1 | 4/2015 | Hao et al. | |
| 2016/0329642 | A1 | 11/2016 | Chainon et al. | |
| 2018/0248241 | A1* | 8/2018 | Frank | H01P 1/207 |

FOREIGN PATENT DOCUMENTS

| | | | |
|---|---|---|---|
| CN | 101635392 | A | 1/2010 |
| CN | 201421887 | Y | 3/2010 |
| CN | 103730728 | A | 4/2014 |
| CN | 204596952 | U | 8/2015 |
| JP | 2004349928 | A | 12/2004 |
| TW | 200929693 | A | 7/2009 |
| WO | 2015101138 | | 7/2015 |

* cited by examiner

RADIATING ELEMENT OF ANTENNA AND ANTENNA

CROSS-REFERENCE TO RELATED APPLICATIONS

This application is a continuation of International Application No. PCT/CN2015/090404, filed on Sep. 23, 2015, the disclosure of which is hereby incorporated by reference in its entirety.

TECHNICAL FIELD

The present invention relates to the communications field, and in particular, to a radiating element of an antenna and an antenna.

BACKGROUND

Extensive use of multiple-antenna technologies such as a multiple-input multiple-output (MIMO for short) technology is accompanied with more applications, which are in an antenna field, of a multi-band antenna capable of working in multiple frequency bands.

Usually, the multi-band antenna includes multiple radiating elements. Each radiating element includes: a reflection module, a power feed printed circuit board (PCB for short) disposed on the reflection module and electrically connected to the reflection module, and a radiating module disposed on the power feed PCB and electrically connected to the power feed PCB. The power feed PCB and the radiating module are commonly grounded (that is, the power feed PCB and the radiating module share a same grounding wire). A signal transmitted by the power feed PCB is radiated out by using the radiating module.

However, in the foregoing radiating element, because the power feed PCB and the radiating module are commonly grounded, a relatively strong crosstalk may occur between the signal transmitted by the power feed PCB and a signal radiated by the radiating module.

SUMMARY

Embodiments of the present invention provide a radiating element of an antenna and an antenna, so as to reduce a crosstalk between a signal transmitted by a power feed PCB and a signal radiated by a radiating module.

To achieve the foregoing objective, the following technical solutions are used in the embodiments of the present invention.

A radiating element of an antenna is provided, including a reflection module, a power feed printed circuit board PCB disposed on the reflection module and electrically connected to the reflection module, and a radiating module disposed on the power feed PCB and electrically connected to the power feed PCB. A first surface of the power feed PCB includes a first signal cable and a grounding area of the radiating module, a second surface of the power feed PCB includes a grounding area of the power feed PCB and a second signal cable, the first signal cable is electrically connected to the second signal cable, and the grounding area of the radiating module is electrically connected to the grounding area of the power feed PCB.

In a first possible implementation of the first aspect, the first surface of the power feed PCB is a surface on which the radiating module is disposed, a grounding electrode of the radiating module is electrically connected to the grounding area of the radiating module, and a signal cable of the radiating module is electrically connected to the second signal cable.

With reference to the first possible implementation of the first aspect, in a second possible implementation, the second signal cable is not connected to the reflection module.

With reference to the second possible implementation of the first aspect, in a third possible implementation, a location that is on the reflection module and that corresponds to the second signal cable is provided with a hole.

With reference to the second possible implementation of the first aspect, in a fourth possible implementation, an insulation layer is disposed in a location that is on the reflection module and that corresponds to the second signal cable.

With reference to any one of the first aspect, or the first possible implementation to the fourth possible implementation of the first aspect, in a fifth possible implementation, the electrical connection is an electrical coupling connection or an electrical direct connection.

With reference to the fifth possible implementation of the first aspect, in a sixth possible implementation, the first signal cable is electrically connected to the second signal cable directly by using a through hole provided on the power feed PCB; or the grounding area of the power feed PCB is electrically connected to the grounding area of the radiating module directly by using a through hole provided on the power feed PCB.

With reference to any one of the first aspect, or the first possible implementation to the sixth possible implementation of the first aspect, in a seventh possible implementation, the following correspondence exists between a length of an edge track of the grounding area of the radiating module and a wavelength corresponding to a center frequency in a frequency band of a signal needing to be suppressed on the radiating element:

$$L=0.5\lambda:5\lambda,$$

where

L is the length of the edge track of the grounding area of the radiating module, and $\lambda$ is the wavelength corresponding to the center frequency in the frequency band of the signal needing to be suppressed on the radiating element.

With reference to any one of the first aspect, or the first possible implementation to the seventh possible implementation of the first aspect, in an eighth possible implementation, the radiating module includes at least one radiator group and a balun feeding power to the at least one radiator group, the at least one radiator group is connected to the power feed PCB by using the balun, each radiator group corresponds to the at least one first signal cable and the at least one second signal cable, and each first signal cable is electrically connected to one second signal cable.

According to a second aspect, an embodiment of the present invention provides an antenna, including the foregoing radiating element.

In a first possible implementation of the second aspect, a quantity of the radiating element is two or more; and grounding areas of radiating modules of any two radiating elements of the two or more radiating elements are different.

The embodiments of the present invention provide the radiating element of an antenna and the antenna. The radiating element may include the reflection module, the power feed PCB disposed on the reflection module and electrically connected to the reflection module, and the radiating module disposed on the power feed PCB and electrically connected to the power feed PCB. The first surface of the power feed PCB includes the first signal cable and the grounding area of the radiating module, the second surface of the power feed PCB includes the grounding area of the power feed PCB and the second signal cable, the first signal cable is electrically connected to the second signal cable, and the grounding area of the radiating module is electrically connected to the grounding area of the power feed PCB.

Based on the foregoing technical solutions, in the radiating element in the embodiments of the present invention, the grounding area of the radiating module is disposed on the first surface of the power feed PCB, the grounding area of the power feed PCB is disposed on the second surface of the power feed PCB, the signal cables (including the first signal cable and the second signal cable) are respectively disposed on the first surface and the second surface of the power feed PCB adaptively, the grounding area of the radiating module is electrically connected to the grounding area of the power feed PCB, and the first signal cable is also electrically connected to the second signal cable. That is, in the radiating element in the embodiments of the present invention, the grounding area of the radiating module and the grounding area of the power feed PCB are set to be two independent grounding areas, so that the radiating module and the power feed PCB are no longer commonly grounded. Therefore, the radiating module can be isolated from the power feed PCB to some extent, so as to reduce a crosstalk between a signal transmitted by the power feed PCB and a signal radiated by the radiating module.

BRIEF DESCRIPTION OF THE DRAWINGS

To describe the technical solutions in the embodiments of the present invention more clearly, the following briefly describes the accompanying drawings required for describing the embodiments or the prior art. Apparently, the accompanying drawings in the following description show merely some embodiments of the present invention, and persons of ordinary skill in the art may still derive other drawings from these accompanying drawings without creative efforts.

DETAILED DESCRIPTION OF ILLUSTRATIVE EMBODIMENTS

The following clearly describes the technical solutions in the embodiments of the present invention with reference to the accompanying drawings in the embodiments of the present invention. Apparently, the described embodiments are merely some but not all of the embodiments of the present invention. All other embodiments obtained by persons of ordinary skill in the art based on the embodiments of the present invention without creative efforts shall fall within the protection scope of the present invention.

A radiating element of an antenna and an antenna that are provided in the embodiments of the present invention may be applied to a base station. The antenna may be a multi-band antenna that can support multiple frequency bands, that is, work in multiple frequency bands. The radiating element may be a single-polarized radiating element, or may be a dual-polarized radiating element.

Figure 1:
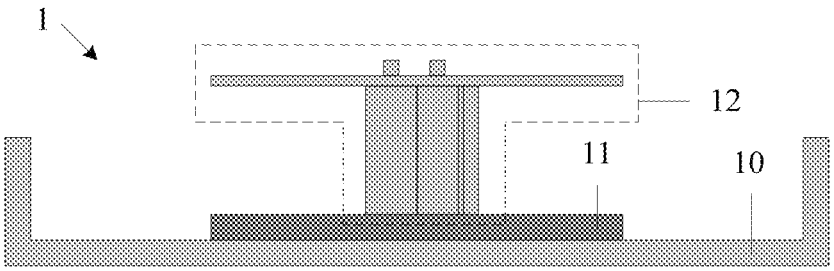
FIG. 1 is a schematic structural diagram 1 of a radiating element according to an embodiment of the present invention.
Figure 2:
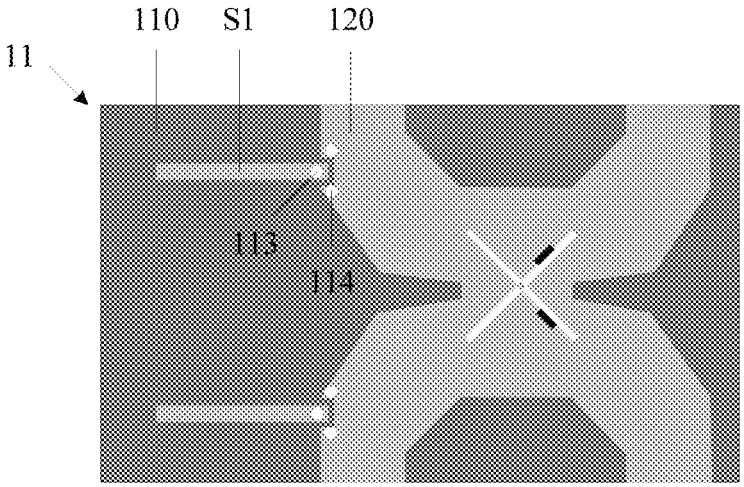
FIG. 2 is a schematic structural diagram 1 of a power feed PCB according to an embodiment of the present invention.
Figure 3:
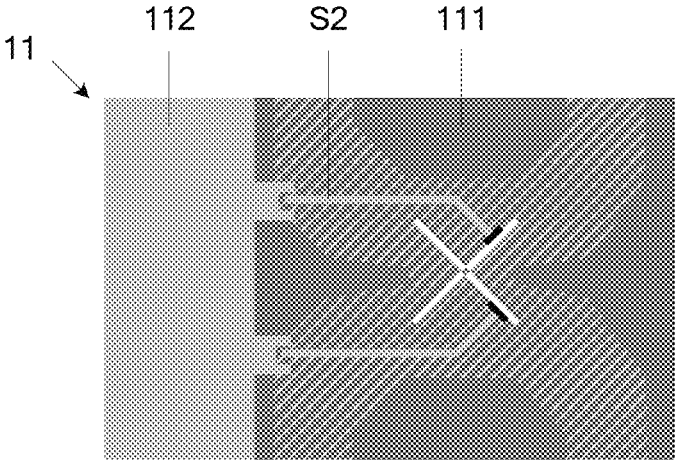
FIG. 3 is a schematic structural diagram 2 of a power feed PCB according to an embodiment of the present invention.

FIG. 1, FIG. 2, and FIG. 3 are schematic structural diagrams of a radiating element of an antenna according to an embodiment of the present invention. As shown in FIG. 1, a radiating element 1 of an antenna provided in this embodiment of the present invention may include a reflection module 10, a power feed PCB 11 disposed on the reflection module 10 and electrically connected to the reflection module 10, and a radiating module 12 disposed on the power feed PCB ii and electrically connected to the power feed PCB 11.

As shown in FIG. 2, a first surface no of the power feed PCB 11 includes a first signal cable S1 and a grounding area 120 of the radiating module 12. As shown in FIG. 3, a second surface 111 of the power feed PCB 11 includes a grounding area 112 of the power feed PCB 11 and a second signal cable S2. The first signal cable S1 is electrically connected to the second signal cable S2, and the grounding area 120 of the radiating module 12 is electrically connected to the grounding area 112 of the power feed PCB 11.

Optionally, in this embodiment of the present invention, the reflection module may be a reflection plate, or may be another component that can reflect a signal radiated by the radiating module (the signal radiated by the radiating module is generally an electromagnetic wave). This is not specifically limited in the present invention.

Preferably, a material of the reflection plate may be metal. That is, the reflection plate may be a metal reflection plate. Because a metal reflection plate relatively strongly reflects an electromagnetic wave, the metal reflection plate can reflect back most energy reaching the reflection plate. Specifically, the metal reflection plate may be an iron reflection plate, may be an aluminum reflection plate, or may be another metal reflection plate. Examples are not provided in the present invention one by one.

In the radiating element provided in this embodiment of the present invention, the power feed PCB transmits a signal to the radiating module, the radiating module radiates out the signal. Because the radiating module radiates the signal in various directions, to ensure that the radiating module radiates the signal in a specific direction, the reflection module may be disposed in other directions different from the specific direction. In this way, most signals reaching the reflection module are reflected by the reflection module to the specific direction, so that radiated power of the radiating element can be increased. A method for radiating a signal by the radiating element in this embodiment of the present invention is the same as a method for radiating a signal by a radiating element in a current system. Therefore, the method for radiating a signal by the radiating element in this embodiment of the present invention is briefly described only, and is not described in detail herein.

To resolve a problem of a current system that because the power feed PCB and the radiating module are commonly grounded, a crosstalk occurs between a signal transmitted by the power feed PCB and a signal radiated by the radiating module, in this embodiment of the present invention, the grounding area of the power feed PCB and the grounding area of the radiating module are designed as two independent grounding areas, so that the power feed PCB and the radiating module are not commonly grounded. Therefore, the power feed PCB can be isolated from the radiating module to some extent, so as to reduce the crosstalk between the signal transmitted by the power feed PCB and the signal radiated by the radiating module.

Persons skilled in the art may understand that, to ensure that a signal can be normally transmitted, the signal cables cannot be connected to the grounding areas. Therefore, correspondingly, in this embodiment of the present invention, the signal cables are also designed as two independent signal cables, that is, the first signal cable the second signal cable.

Specifically, in the radiating element provided in this embodiment of the present invention, the first signal cable and the grounding area of the radiating module are disposed on the first surface of the power feed PCB, the second signal cable and the grounding area of the power feed PCB are disposed on the second surface of the power feed PCB, the first signal cable is electrically connected to the second signal cable, and the grounding area of the radiating module is electrically connected to the grounding area of the power feed PCB. The grounding area of the radiating module is isolated from the grounding area of the power feed PCB by using a plate dielectric of the power feed PCB. Therefore, a crosstalk between a signal transmitted by the power feed PCB and a signal radiated by the radiating module can be reduced.

It should be noted that the accompanying drawings in this embodiment of the present invention are merely used to describe an example of the radiating element provided in this embodiment of the present invention. All other accompanying drawings obtained by persons skilled in the art by making simple modifications, replacements, or the like on the accompanying drawings provided in this embodiment of the present invention shall fall within the protection scope of the present invention.

Further, in all the foregoing accompanying drawings, the radiating element provided in this embodiment of the present invention is described by using an example in which the radiating element is a dual-polarized radiating element. Each polarized radiating element corresponds to one signal cable (that is, the first signal cable or the second signal cable in this embodiment of the present invention). For example, as shown in FIG. 4, A and B may be one polarized radiating element, C and D may be another polarized radiating element, A and B correspond to one first signal cable and one second signal cable, and C and D correspond to another first signal cable and another second signal cable.

Certainly, one polarized radiating element may also correspond to two or more signal cables (that is, the first signal cable and the second signal cable in this embodiment of the present invention). In this way, two or more signal cables simultaneously transmit signals to one polarized radiating element (that is, signal excitation is performed on one polarized radiating element), so that radiated power of the radiating element can be increased.

Optionally, in the radiating element provided in this embodiment of the present invention, the first surface of the power feed PCB may be a surface on which the radiating module is disposed, and the second surface of the power feed PCB is a surface on which the reflection module is disposed. In contrast, the first surface of the power feed PCB may also be a surface on which the reflection module is disposed, and the second surface of the power feed PCB is a surface on which the radiating module is disposed. Specifically, this is not limited in the present invention.

Figure 4:
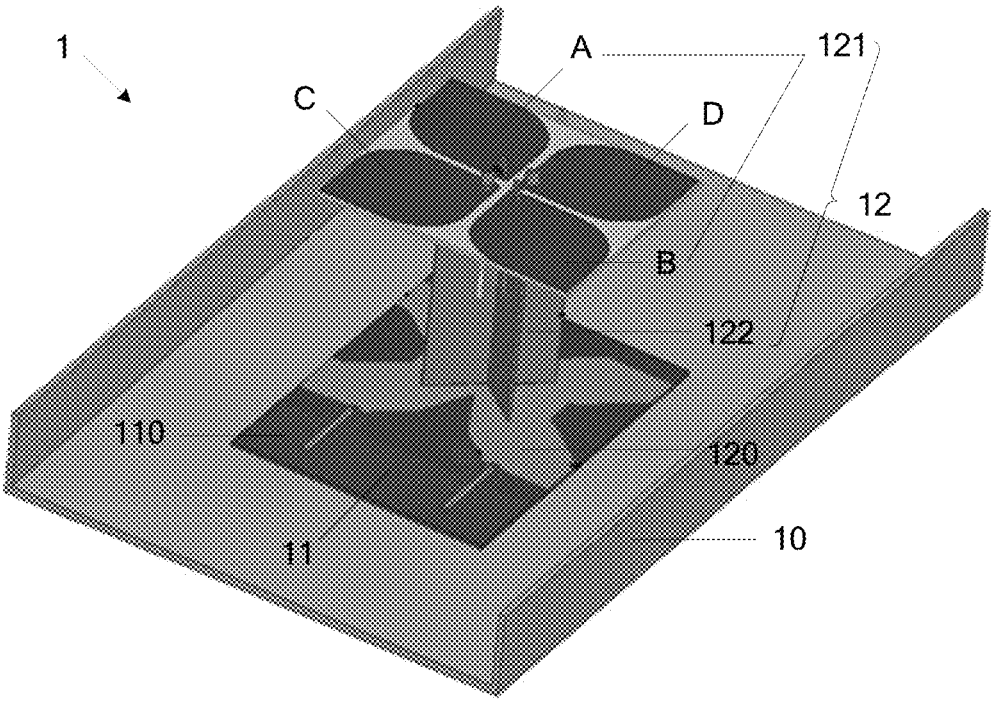
FIG. 4 is a schematic structural diagram 2 of a radiating element according to an embodiment of the present invention.

Preferably, as shown in FIG. 4, the first surface 110 of the power feed PCB 11 is a surface on which the radiating module 12 is disposed, a grounding electrode of the radiating module 12 is electrically connected to the grounding area 120 of the radiating module 12, and a signal cable of the radiating module 12 is electrically connected to the second signal cable.

As shown in FIG. 4, in this embodiment of the present invention, the radiating module 12 may include a radiator group 121 and a balun 122 feeding power to the radiator group 121. The grounding electrode of the radiating module 12 may be a grounding electrode of the balun 122, and the signal cable of the radiating module 12 may be a feeder that is on the balun 122 and that feeds power to the radiator group.

The balun is a balanced to unbalanced transformer, and is configured to perform signal conversion between a balanced line and an unbalanced line. The balanced to unbalanced transformer is a transformer, and may convert an unbalanced signal into a balanced signal, or may convert a balanced signal into an unbalanced signal. Usually, the balanced to unbalanced transformer is mainly applied to an antenna. The balanced to unbalanced transformer is responsible for converting an unbalanced signal into a balanced signal, so that a directivity pattern of the antenna becomes symmetric.

Specifically, in this embodiment of the present invention, a manner of connecting the radiating module and the power feed PCB (including a manner of connecting the signal cable of the radiating module and the second signal cable on the power feed PCB, and a manner of connecting the grounding electrode of the radiating module and the grounding area of the radiating module on the power feed PCB) is similar to a manner of connecting a radiating module and a power feed PCB in a current system. Therefore, the manner of connecting the radiating module and the power feed PCB is not described herein.

In the radiating element provided in this embodiment of the present invention, the grounding area of the radiating module is disposed on the first surface of the power feed PCB, that is, a surface, on which the radiating module is disposed, of the power feed PCB, so that the grounding electrode of the radiating module may be electrically connected to the grounding area of the radiating module directly, that is, the grounding electrode of the radiating module and the grounding area of the radiating module are directly conducted. Therefore, connection impedance between the grounding electrode of the radiating module and the grounding area of the radiating module can be reduced.

Optionally, when the second surface of the power feed PCB is a surface on which the reflection module is disposed, because in the radiating element provided in this embodiment of the present invention, the reflection module may be a metal reflection plate, to ensure quality of a signal transmitted by the power feed PCB, it may be usually set that the second signal cable located on the second surface of the power feed PCB is not connected to the reflection module.

It should be noted that the being not connected mentioned in this embodiment of the present invention is that there is no electrical connection, that is, there is no electrical coupling connection or no electrical direct connection. For example, that the second signal cable is not connected to the reflection module may be understood as: There is no electrical connection between the second signal cable and the reflection module, that is, there is neither an electrical coupling connection nor an electrical direct connection between the second signal cable and the reflection module.

Figure 5:
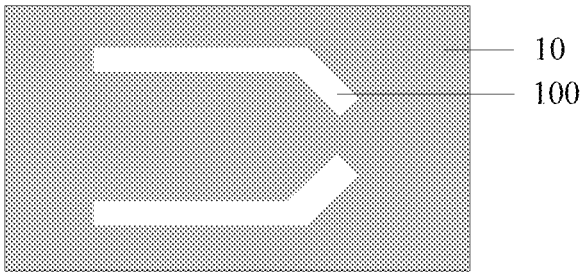
FIG. 5 is a schematic structural diagram 1 of a reflection module according to an embodiment of the present invention.

Optionally, as shown in FIG. 5, a location that is on the reflection module 10 and that corresponds to the second signal cable is provided with a hole 100.

In this embodiment of the present invention, the location that is on the reflection module and that corresponds to the second signal cable is provided with the hole. This may avoid that the second signal cable is connected to the reflection module, so as to avoid that the second signal cable and the reflection module are conducted. Therefore, quality of a signal transmitted by the power feed PCB is ensured.

Figure 6:
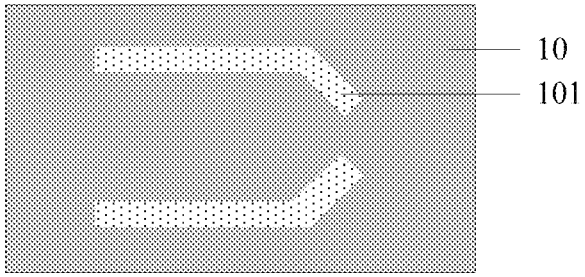
FIG. 6 is a schematic structural diagram 2 of a reflection module according to an embodiment of the present invention.

Optionally, as shown in FIG. 6, an insulation layer 101 is disposed in a location that is on the reflection module 10 and that corresponds to the second signal cable.

In this embodiment of the present invention, the insulation layer is disposed in the location that is on the reflection module and that corresponds to the second signal cable. This may avoid that the second signal cable is connected to the reflection module, so as to avoid that the second signal cable and the reflection module are conducted. Therefore, quality of a signal transmitted by the power feed PCB is ensured.

The insulation layer may be a component, such as an insulation film, insulation paper, or an insulation plate, having an insulation function, and may be specifically selected according to an actual use requirement. This is not limited in the present invention.

The insulation layer may be a transparent insulation layer, or may be a non-transparent insulation layer, and may be specifically selected according to an actual use requirement. This is not limited in the present invention.

A shape of the insulation layer may be designed according to a shape of the second signal cable. For example, a shape of an insulation layer shown in FIG. 6 is the same as the shape of the second signal cable.

Optionally, in the radiating element provided in this embodiment of the present invention, an electrical connection between various components may be an electrical coupling connection or an electrical direct connection.

Specifically, in an actual application, an electrical connection between the signal cables is usually an electrical direct connection. In this way, relatively desirable quality of a signal transmitted on the signal cable is ensured. For example, in this embodiment of the present invention, the first signal cable is electrically connected to the second signal cable directly. In this way, even if the first signal cable and the second signal cable are respectively disposed on two surfaces of the power feed PCB, a signal transmitted by the power feed PCB can still be transmitted to the radiating module by using the first signal cable and the second signal cable.

In this embodiment of the present invention, a connection between the grounding areas may be an electrical direct connection, or may be an electrical coupling connection, and may be specifically designed according to an actual use requirement. This is not limited in the present invention.

In the radiating element in this embodiment of the present invention, that the reflection module is electrically connected to the power feed PCB is specifically: A reflection module is electrically connected to the grounding area of the power feed PCB (the electrical connection may be an electrical coupling connection or an electrical direct connection). That the power feed PCB is electrically connected to the radiating module is specifically: The grounding area (disposed on the first surface of the power feed PCB) of the radiating module is electrically connected to the grounding electrode of the radiating module (the electrical connection may be an electrical coupling connection or an electrical direct connection), and the second signal cable (disposed on the second surface of the power feed PCB) is electrically connected to the signal cable of the radiating module directly.

Figure 7:
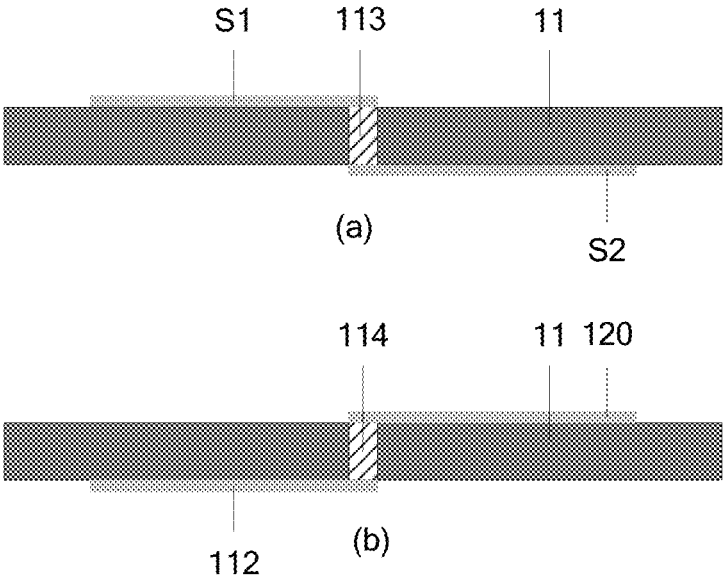
FIG. 7 is a schematic structural diagram 3 of a radiating element according to an embodiment of the present invention.

Optionally, with reference to FIG. 2 and FIG. 7, FIG. 2 is a top view of a first surface of a power feed PCB, and FIG. 7 is a cutaway view of a power feed PCB. As shown in (a) in FIG. 7, the first signal cable S1 is electrically connected to the second signal cable S2 directly by using a through hole 113 provided on the power feed PCB 11; or as shown in (b) in FIG. 7, the grounding area 112 of the power feed PCB ii is electrically connected to the grounding area 120 of the radiating module directly by using a through hole 114 provided on the power feed PCB 11.

To more clearly describe a manner of connecting the first signal cable and the second signal cable, and a manner of connecting the grounding area of the power feed PCB and the grounding area of the radiating module, an example of the manner of connecting the first signal cable and the second signal cable, and an example of the manner of connecting the grounding area of the power feed PCB and the grounding area of the radiating module are described independently in the foregoing embodiment by using (a) in FIG. 7 and (b) in FIG. 7 as examples respectively. Persons skilled in the art all know that in an actual application, the first signal cable, the second signal cable, the grounding area of the power feed PCB, and the grounding area of the radiating module are all disposed on the power feed PCB; the first signal cable and the grounding area of the radiating module are disposed on one surface of the power feed PCB (for example, the first surface of the power feed PCB), and the second signal cable and the grounding area of the power feed PCB are disposed on the other surface of the power feed PCB (for example, the second surface of the power feed PCB).

It should be noted that in the radiating element provided in this embodiment of the present invention, the first signal cable may be electrically connected to the second signal cable directly by using the through hole provided on the power feed PCB; the grounding area of the power feed PCB may be electrically connected to the grounding area of the radiating module directly by using the through hole provided on the power feed PCB, or the grounding area of the power feed PCB may be electrically connected to the grounding area of the radiating module in a coupling manner by using a plate dielectric between the grounding area of the power feed PCB and the grounding area of the radiating module. Selection may be specifically performed according to an actual use requirement, and this is not limited in the present invention.

Optionally, in this embodiment of the present invention, a shape of the grounding area of the radiating module may be designed according to an actual use requirement. For example, FIG. 2 shows a possible shape of the grounding area 120 of the radiating module. Certainly, a shape of the radiating module in this embodiment of the present invention includes, but is not limited to, the shape of the grounding area of the radiating module shown in FIG. 2. That is, the shape of the grounding area of the radiating module may be adaptively transformed according to an actual use requirement. For example, the shape of the grounding area 120 of the radiating module shown in FIG. 2 may be transformed into a shape of the grounding area 120 of the radiating module shown in FIG. 8.

Preferably, in this embodiment of the present invention, the following correspondence exists between a length of an edge track of the grounding area of the radiating module and a wavelength corresponding to a center frequency in a frequency band of a signal needing to be suppressed on the radiating element:

$$L=0.5\lambda:5\lambda \quad \text{(formula 1)},$$

where

L is the length of the edge track of the grounding area of the radiating module, and λ is the wavelength corresponding to the center frequency in the frequency band of the signal needing to be suppressed on the radiating element.

Persons skilled in the art may understand that, in an actual application, a multi-band antenna can usually support multiple frequency bands, and each frequency in each frequency band corresponds to one wavelength. For a radiating element, to ensure that the radiating element can stably work in a frequency band, that is, radiate a signal in the frequency band, a signal in another frequency band needs to be suppressed on the radiating element. According to this principle, in this embodiment of the present invention, the shape of the grounding area of the radiating module in the radiating element may be designed according to the wavelength corresponding to the center frequency in the frequency band of the signal needing to be suppressed on the radiating element. Specifically, the length of the edge track of the grounding area of the radiating module in the radiating element and the wavelength corresponding to the center frequency in the frequency band of the signal needing to be suppressed on the radiating element meet the correspondence shown in the foregoing formula 1. This is not described herein again.

Figure 8:
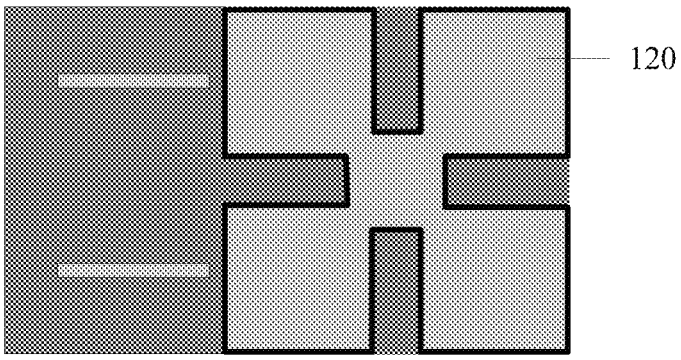
FIG. 8 is a schematic structural diagram 3 of a power feed PCB according to an embodiment of the present invention.

For example, using the shape of the grounding area of the radiating module shown in FIG. 8 as an example, the length of the edge track of the grounding area of the radiating module may be a track length of a black bold line in FIG. 8.

Optionally, in the radiating element in this embodiment of the present invention, as shown in FIG. 4 (only an example in which the radiating module includes two radiator groups is used for description in FIG. 4), the radiating module 12 includes at least one radiator group 121 and a balun 122 feeding power to the at least one radiator group 121. The at least one radiator group 121 is connected to the power feed PCB 11 by using the balun 122. Each radiator group corresponds to the at least one first signal cable and the at least one second signal cable, and each first signal cable is electrically connected to one second signal cable.

In this embodiment of the present invention, the radiating element may be a single-polarized radiating element, or may be a dual-polarized radiating element. The single-polarized radiating element includes one radiator group and a balun feeding power to the radiator group. The dual-polarized radiating element includes two radiator groups and a balun feeding power to the two radiator groups. Regardless of whether the radiating element is a single-polarized radiating element or a dual-polarized radiating element, each radiator group may correspond to at least one first signal cable and at least one second signal cable, and each first signal cable is electrically connected to one second signal cable.

Specifically, in this embodiment of the present invention, one signal cable (including one first signal cable and one second signal cable) may transmit a signal to a radiator group (that is, a polarized radiating element). Alternatively, two or more signal cables may simultaneously transmit a signal to a radiator group. This is not limited in the present invention.

The foregoing transmitting a signal to a radiator group may also be understood as performing signal excitation on the radiator group.

Optionally, the foregoing radiator group may include two or more radiator groups. For example, as shown in FIG. 4, a radiating element 1 is a dual-polarized radiating element, A, B, C, and D are four radiators, and two radiators along a diagonal direction form one radiator group. That is, A and B form one radiator group, and C and D form one radiator group. A radiating element corresponding one radiator group is one polarized radiating element. That is, radiating elements corresponding to the two radiator groups are one dual-polarized radiating element.

This embodiment of the present invention provides the radiating element. In the radiating element, the grounding area of the radiating module is disposed on the first surface of the power feed PCB, the grounding area of the power feed PCB is disposed on the second surface of the power feed PCB, the signal cables (including the first signal cable and the second signal cable) are respectively disposed on the first surface and the second surface of the power feed PCB adaptively, the grounding area of the radiating module is electrically connected to the grounding area of the power feed PCB, and the first signal cable is also electrically connected to the second signal cable. That is, in the radiating element in this embodiment of the present invention, the grounding area of the radiating module and the grounding area of the power feed PCB are set to be two independent grounding areas, so that the radiating module and the power feed PCB are no longer commonly grounded. Therefore, the radiating module can be isolated from the power feed PCB to some extent, so as to reduce a crosstalk between a signal transmitted by the power feed PCB and a signal radiated by the radiating module.

Figure 9:
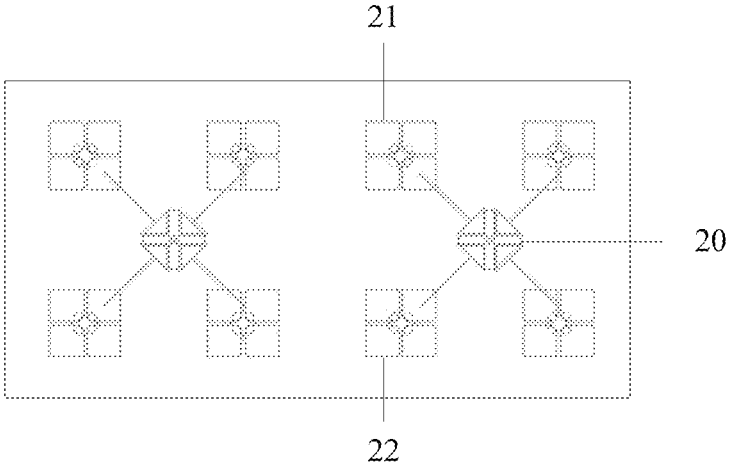
FIG. 9 is a schematic structural diagram of an antenna according to an embodiment of the present invention.

As shown in FIG. 9, an embodiment of the present invention provides an antenna. The antenna may include at least one radiating element described above.

For descriptions of the radiating element, specifically refer to related descriptions of the radiating element shown in FIG. 1 to FIG. 8 in the foregoing embodiment, and details are not described herein again.

It should be noted that the antenna in this embodiment of the present invention may be a multi-band antenna that can work in multiple frequency bands. The multi-band antenna may include multiple radiating elements. In the foregoing embodiment, only one radiating element is used as an example for description in FIG. 1 to FIG. 8. A structure, a principle, and the like of another radiating element are all the same as a structure, a principle, and the like of the radiating element shown in FIG. 1 to FIG. 8. Specifically, for the structure, the principle, and the like of the another radiating element, refer to related descriptions of the structure, the principle, and the like of the radiating element shown in FIG. 1 to FIG. 8 in the foregoing embodiment. Details are not described herein again.

For example, FIG. 9 is a schematic structural diagram of a possible multi-band antenna. The multi-band antenna includes a low-frequency radiating element 20 arranged in the middle, and multiple first high-frequency radiating elements 21 and multiple second high-frequency radiating elements 22 that are arranged on two sides. The multiple first high-frequency radiating elements 21 work in a same frequency band. The multiple second high-frequency radiating elements 22 work in a same frequency band. The multiple first high-frequency radiating elements 21 and the multiple second high-frequency radiating elements 22 work in different frequency bands.

It should be noted that all radiating elements in this embodiment of the present invention are high-frequency radiating elements in the antenna, such as the first high-frequency radiating element 21 and the second high-frequency radiating element 22 that are shown in FIG. 9.

This embodiment of the present invention provides the antenna. The antenna includes the radiating element. A grounding area of a radiating module is disposed on a first surface of a power feed PCB, a grounding area of the power feed PCB is disposed on a second surface of the power feed PCB, signal cables (including a first signal cable and a second signal cable) are respectively disposed on the first surface and the second surface of the power feed PCB adaptively, the grounding area of the radiating module is electrically connected to the grounding area of the power feed PCB, and the first signal cable is also electrically connected to the second signal cable. That is, in the radiating element in this embodiment of the present invention, the grounding area of the radiating module and the grounding area of the power feed PCB are set to be two independent grounding areas, so that the radiating module and the power feed PCB are no longer commonly grounded. Therefore, the radiating module can be isolated from the power feed PCB to some extent, so as to reduce a crosstalk between a signal transmitted by the power feed PCB and a signal radiated by the radiating module.

Optionally, in the multi-band antenna, a quantity of the radiating element is two or more; and grounding areas of radiating modules of any two radiating elements of the two or more radiating elements are different.

It should be noted that, that grounding areas of radiating modules of any two radiating elements mentioned in this embodiment of the present invention are different means that the grounding areas of the radiating modules of the any two radiating elements are independent grounding areas. That is, the radiating modules of the any two radiating elements are not commonly grounded.

In the multi-band antenna provided in this embodiment of the present invention, because a grounding area of each radiating element is designed as an independent grounding area, these radiating elements are no longer commonly grounded. Therefore, mutual coupling between these radiating elements is reduced, and a radiation indicator of each radiating element is effectively improved, such as isolation between radiating elements and a directivity pattern of each radiating element.

In the antenna provided in this embodiment of the present invention, in each radiating element, the grounding area of the radiating module and the grounding area of the power feed PCB are set to be two independent grounding areas, so that the radiating module and the power feed PCB are no longer commonly grounded. Therefore, in the antenna, the grounding area of each radiating element may be an independent grounding area, that is, radiating elements are also not commonly grounded. Therefore, compared with a current system in which all radiating elements are commonly grounded, the antenna provided in this embodiment of the present invention can isolate each radiating element to some extent, so that a crosstalk when each radiating element radiates a signal and electromagnetic coupling between radiating elements can be reduced.

The foregoing descriptions about implementations allow persons skilled in the art to understand that, for the purpose of convenient and brief description, division of the foregoing function modules is taken as an example for illustration. In actual application, the foregoing functions can be allocated to different modules and implemented according to a requirement, that is, an inner structure of an apparatus is divided into different function modules to implement all or part of the functions described above. For a detailed working process of the foregoing system, apparatus, and unit, reference may be made to a corresponding process in the foregoing method embodiments, and details are not described herein again.

In the several embodiments provided in this application, it should be understood that the disclosed system, apparatus, and method may be implemented in other manners. For example, the described apparatus embodiment is merely an example. For example, the module or unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented by using some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. Some or all of the units may be selected according to actual requirements to achieve the objectives of the solutions of the embodiments.

In addition, functional units in the embodiments of the present invention may be integrated into one processing unit, or each of the units may exist alone physically, or two or more units are integrated into one unit. The foregoing integrated unit may be implemented in a form of hardware.

The foregoing descriptions are merely specific implementations of the present invention, but are not intended to limit the protection scope of the present invention. Any variation or replacement readily figured out by persons skilled in the art within the technical scope disclosed in the present invention shall fall within the protection scope of the present invention. Therefore, the protection scope of the present invention shall be subject to the protection scope of the claims.

What is claimed is:

1. A radiating element of an antenna, comprising:

a reflection module;

a power feed printed circuit board (PCB) disposed on the reflection module and electrically connected to the reflection module; and a radiating module disposed on the power feed PCB and electrically connected to the power feed PCB;

wherein a first signal cable and a grounding area of the radiating module extend along a first surface of the power feed PCB, a grounding area of the power feed PCB and a second signal cable extend along a second surface of the power feed PCB, the first signal cable is electrically connected to the second signal cable, the grounding area of the radiating module is electrically connected to the grounding area of the power feed PCB, the radiating module directly physically contacts the grounding area of the radiating module, and the grounding area of the radiating module comprises a conductive material laterally extending along the first surface of the power feed PCB at a same level as the first signal cable.

2. The radiating element according to claim 1, wherein a grounding electrode of the radiating module is electrically connected to the grounding area of the radiating module, and a signal cable of the radiating module is electrically connected to the second signal cable.

3. The radiating element according to claim 2, wherein the second signal cable is electrically insulated from the reflection module.

4. The radiating element according to claim 3, wherein a location that is on the reflection module and that corresponds to a location of the second signal cable comprises a hole.

5. The radiating element according to claim 3, wherein an insulation layer is disposed in a location that is on the reflection module and that corresponds to a location of the second signal cable.

6. The radiating element according to claim 1, wherein the first signal cable is electrically connected to the second signal cable directly by using a first through hole of the power feed PCB; and the grounding area of the power feed PCB is electrically connected to the grounding area of the radiating module directly by using a second through hole of the power feed PCB.

7. The radiating element according to claim 1, wherein a correspondence exists between a length of an edge track of the grounding area of the radiating module and a wavelength corresponding to a center frequency in a frequency band of a signal needing to be suppressed on the radiating element:

$$L=0.5\lambda:5\lambda,$$

wherein L is the length of the edge track of the grounding area of the radiating module, and $\lambda$ is the wavelength corresponding to the center frequency in the frequency band of the signal needing to be suppressed on the radiating element.

8. The radiating element according to claim 1, wherein the radiating module comprises at least one radiator group and a balun feeding power to the at least one radiator group, the at least one radiator group is connected to the power feed PCB using the balun, each radiator group corresponds to at least one first signal cable and at least one second signal cable, the at least one first signal cable includes the first signal cable and the at least one second signal cable includes the second signal cable, and each first signal cable is electrically connected to one second signal cable.

9. An antenna, comprising a radiating element, wherein the radiating element comprises:

a reflection module;

a power feed printed circuit board (PCB) disposed on the reflection module and electrically connected to the reflection module, wherein a second surface of the power feed PCB directly physically contacts the reflection module; and a radiating module disposed on the power feed PCB and electrically connected to the power feed PCB, wherein a first surface of the power feed PCB directly physically contacts a first surface of the radiating module, and the first surface of the power feed PCB is opposite to the second surface of the power feed PCB;

wherein a first signal cable and a grounding area of the radiating module extend along the first surface of the power feed PCB, a grounding area of the power feed PCB and a second signal cable extend along the second surface of the power feed PCB, the first signal cable is directly electrically connected to the second signal cable, the grounding area of the radiating module is electrically connected to the grounding area of the power feed PCB, and the grounding area of the radiating module laterally extends beyond the first surface of the radiating module along the first surface of the power feed PCB.

10. The antenna according to claim 9, further comprising a second radiating element, wherein grounding areas of radiating modules of the radiating element and the second radiating element are different.

11. The antenna according to claim 9, wherein a grounding electrode extends along the first surface of the radiating module, and the grounding electrode physically contacts the grounding area of the radiating module.

12. The antenna according to claim 11, wherein the reflection module is electrically isolated from the second signal cable.

13. The antenna according to claim 9, wherein the grounding area of the radiating module comprises a conductive material that extends from a first sidewall of the power feed PCB to a second sidewall of the power feed PCB, the first sidewall being opposite to the second sidewall.

* * * * *